US008894181B2

(12) United States Patent
Almadhi

(10) Patent No.: US 8,894,181 B2
(45) Date of Patent: Nov. 25, 2014

(54) PRINTING SYSTEM AND METHOD

(75) Inventor: Fahad S. A. Almadhi, Riyadh (SA)

(73) Assignee: King Saud University, Riyadh (SA)

( * ) Notice: Subject to any disclaimer, the term of this patent is extended or adjusted under 35 U.S.C. 154(b) by 40 days.

(21) Appl. No.: 12/967,788

(22) Filed: Dec. 14, 2010

(65) Prior Publication Data

US 2011/0164089 A1 Jul. 7, 2011

Related U.S. Application Data

(60) Provisional application No. 61/282,225, filed on Jan. 4, 2010.

(51) Int. Cl.
*B41J 2/145* (2006.01)
*B41J 2/235* (2006.01)

(52) U.S. Cl.
CPC ..... *B41J 2/235* (2013.01)
USPC ..... 347/40

(58) Field of Classification Search
USPC ..... 347/40–43; 400/124.01, 124.08, 400/124.14, 124.15; 101/93.04, 93.05, 327
See application file for complete search history.

(56) References Cited

U.S. PATENT DOCUMENTS

| | | | | |
|---|---|---|---|---|
| 173,718 | A | 2/1876 | Edison | |
| 3,151,543 | A * | 10/1964 | Preisinger | 101/93.04 |
| 3,329,964 | A | 7/1967 | Mutschler et al. | |
| 4,279,519 | A | 7/1981 | Shiurila | |
| 4,643,599 | A | 2/1987 | Taguchi et al. | |
| 4,806,956 | A * | 2/1989 | Nishikawa et al. | 347/55 |
| 4,913,568 | A | 4/1990 | Torisawa | |
| 4,984,911 | A | 1/1991 | Nakayama | |
| 6,123,469 | A | 9/2000 | Suzuki et al. | |
| 6,176,629 | B1 | 1/2001 | Suzuki et al. | |
| 6,561,707 | B2 | 5/2003 | Garramone et al. | |
| 6,695,496 | B2 | 2/2004 | Nakagaki et al. | |
| 6,849,127 | B2 * | 2/2005 | Vann et al. | 118/401 |
| 7,547,096 | B2 * | 6/2009 | Matysiak | 347/85 |

FOREIGN PATENT DOCUMENTS

| | | | |
|---|---|---|---|
| JP | 57159662 | A | 10/1982 |
| JP | 61280947 | A | 12/1986 |

* cited by examiner

*Primary Examiner* — Daniel Petkovsek
(74) *Attorney, Agent, or Firm* — Richard C. Litman

(57) ABSTRACT

The printing system is a dot matrix-type printer utilizing a liquid ink reservoir. A plurality of pins are disposed within the reservoir, each pin having a lower end and a tapered upper end terminating in a printing tip. In use, the reservoir is held stationary, the liquid ink being contained therein by gravity. A printing substrate, such as a piece of paper, is drawn over an open upper end of the reservoir. A driver selectively vertically translates the plurality of pins, each individual pin being selectively driven independent of the other pins. Each pin is initially positioned so that the lower end thereof is located adjacent a lower wall of the reservoir, and the printing tip is positioned beneath a surface of the ink. A selected pin is translated upwardly so that the printing tip thereof contacts the printing substrate to form an ink dot thereon.

13 Claims, 8 Drawing Sheets

PRINTING SYSTEM AND METHOD

CROSS-REFERENCE TO RELATED APPLICATION

This application claims the benefit of U.S. Provisional Patent Application Ser. No. 61/282,225, filed Jan. 4, 2010.

BACKGROUND OF THE INVENTION

1. Field of the Invention

The present invention relates to ink printers and, particularly, to a printing system and method having a dot matrix-type printer using a liquid ink reservoir.

2. Description of the Related Art

Dot matrix printers (sometimes referred to as "impact matrix printers") are well known in the art. A dot matrix printer is a type of computer printer with a print head that runs back and forth, or in an up and down motion, on the page and prints by impact, striking an ink-soaked cloth ribbon against the paper, much like a typewriter. Unlike a typewriter or daisy wheel printer, letters are drawn out of a dot matrix, and thus, varied fonts and arbitrary graphics can be produced.

FIGS. 2A and 2C illustrate a conventional dot matrix printer head 100. The rear end of member 11 is provided with an upwardly projecting wall 14, as shown, having a plurality of tapped openings 15. The rearwardly directed surface of wall 14 has a truncated pyramidal configuration. The openings 15 provided on the rear surface are aligned so as to be substantially perpendicular to their associated mounting surfaces.

Each of the openings is tapped to threadably engage the threaded collar 17 of a solenoid assembly 18. FIG. 2B shows a cross-sectional view of one solenoid assembly 18 removed from the assembly 10 in order to show the internal structure in detail. The remaining solenoid assemblies are similarly provided with threaded collars for threadably engaging an associated one of the tapped apertures 15. Each solenoid has a slender solenoid wire 19 projecting outwardly through an opening provided at the forward end of each tapped collar 17, from which print wires extend from the forward end of each solenoid assembly to the forward or left-hand end of member 11.

Die cast member 11 is further provided with a first mounting portion 20 having a first groove 21 provided in a first upright portion 22 and a groove 21*a* provided in a second upright portion 24. The grooves 21 and 21*a* are adapted to receive a flat plate 25 provided with a plurality of openings 26, each receiving an associated one of the solenoid wires 19.

A second supporting section 27 die cast as an integral part of member 11 and positioned in front of section 20 is comprised of a first groove 28 extending from a first upright portion 29 and a second groove 28*a* provided in a second upright portion 30. These grooves are adapted to receive a flat plate 31 provided with a plurality of openings 32, each receiving an associate one of the solenoid wires 19.

A final upright portion 34 is die cast as an integral portion of member 11 and is provided with a centrally located opening 35, with the opening widening at ledge 38 to form a wider opening 39. In operation, the solenoid wires 19 may be selectively moved in the directions shown by arrows 40 and 41 (as shown in FIG. 2D) so as to selectively impact against a paper tape (not shown) positioned in close proximity to the front end of the printer head assembly. In order that the constant and rapid movement of the print wires be subjected to a minimum amount of abrasive wear, a plurality of tube guides 42 are provided. Each of the tube guides 42 is comprised of a hollow, elongated sleeve formed of a metallic material which is force-fitted through an associated opening 26 in disc 25 and which receives a print wire through its central opening so as to prevent any abrasive wear between the solenoid wires and the disc 25.

FIG. 2B shows a detailed sectional view of one of the print wire solenoids 18, which includes a one-piece shell member 50 whose right-hand portion is substantially cylindrical in shape and is threaded at 17. A fastening nut 51 threadably engages threaded collar 17 for the purpose of tightening or locking the solenoid to the upright wall 14 once the solenoid is mounted in the desired position. The left-hand portion of shell 50 is also cylindrical in shape and has a cylindrical wall 53 to form a hollow annular shaped interior region 54 which houses the solenoid coil 55. The central core portion 52 has a centrally located opening 56 for slidably receiving print wire 19 which is secured to the left-hand end of cylindrical shaped armature member 57 and which passes through opening 56 to a wider opening 56*a* and a still wider opening 56*b* provided in shell 50. A tubular shaped wire guide 58 surrounds a portion of print wire 19, as shown. The solenoid coil 55 is provided with a pair of connecting leads 59 for coupling the print solenoid to driving circuitry. The connecting leads 59 extend through an opening 60 provided near the left-hand end of shell 50.

The armature member 57, which is formed of a permanent magnet material, is secured to a circular shaped disc 61, formed of a springy or resilient metallic material, by means of rivet 62. A thin wafer 63 is positioned between armature 57 and the left-hand surface of spring 61 and a second wafer 64 is positioned between the right-hand surface of spring 61 and the head of rivet 62, to reduce vibration.

A relatively thick disc shaped member 65, having a central opening 65*a*, is positioned within shell 50 and has a continuous annular shaped projecting flange portion 65*b* engaging the left-hand surface of spring 61. The armature assembly, including spring 61 and armature 57, as well as disc 65, is rigidly secured within shell 50 by means of a cap 66 having a tapped interior surface 67 which threadably engages the threaded portion 68 of shell 50.

In operation, with the coil assembly 55 de-energized, spring 61 assumes its flat shape, as shown in FIG. 2B. Upon energization of coil assembly 55, the magnetic field generated by coil 55 urges armature 57 in a direction shown by arrow A against the biasing force imposed upon the armature by spring 61 thereby moving print wire. When the coil assembly 55 is de-energized, armature 57 is caused to return to the position shown in FIG. 2B under the influence of the biasing spring 61. The print solenoid is adjusted so as to cause the print wire to move approximately 0.45 to 0.56 mm toward the right when the coil assembly is energized, thereby causing the extreme left-hand end of the print wire to extend by the above-mentioned distance in order to impact a ribbon (not shown) and thereby print a dot upon a paper document supported by a platen (not shown).

The coil assembly is wound upon a cylindrical shaped bobbin 70, which is then inserted into the hollow annular portion 54 of shell 50. The tubular shaped wire guide 58 has its left-hand portion secured to the interior opening 56*a* by means of a suitable epoxy. An epoxy is also preferably applied between the threaded portion 68 of shell 50 and the tapped portion 67 of cap 66 in order to firmly join the shell 53 and cap 66 after appropriate adjustment (i.e., tightening) of cap 66 upon the shell. A small opening 66*a* is provided at the center of cap 66 to adjust the amount of travel which the armature 57 may experience and to thereby control the amount of travel experienced by each print wire 19.

Printer head 100, shown in FIGS. 2A-2D, is a conventional dot matrix printer head. As seen from the above, there is great mechanical complexity, on a very small scale, required to form a sequence of dots (to form characters or graphics) on a piece of paper. Misalignment of any one element will cause misalignments of the connecting parts, thus making printer head 100 highly susceptible to damage. A dot printer head with a minimum of interlinking, complex parts would be desirable.

Thus, a printing system and method solving the aforementioned problems is desired.

SUMMARY OF THE INVENTION

The printing system is a dot matrix-type printer utilizing a liquid ink reservoir. The reservoir includes a lower wall, at least one sidewall and an open upper end. The reservoir is adapted for receiving a volume of liquid ink. A plurality of pins are disposed within the reservoir, each pin having a lower end and a tapered upper end terminating in a printing tip. The plurality of pins are arrayed in parallel rows within the reservoir, each pin extending vertically with respect to the reservoir.

In use, the reservoir is held stationary, the liquid ink being contained therein by gravity alone. A printing substrate, such as a piece of paper, is drawn over the open upper end of the reservoir by conventional means, such as rollers or the like. Thus, as opposed to a conventional dot matrix printer, where a printer head moves relative to a stationary piece of paper, the paper of the present system moves relative to the stationary reservoir.

A driver selectively vertically translates the plurality of pins, with each individual pin being selectively driven separate of the other pins. In a non-printing state, each pin is positioned so that the lower end is located adjacent the lower wall of the reservoir, and the printing tip is positioned beneath the surface of the volume of ink received within the reservoir. Upon selective vertical translation of one of the pins, the selected pin is translated upwardly so that the printing tip thereof contacts the printing substrate to form a dot thereon, the ink being carried on the surface of the printing tip of the pin. The pin is then selectively lowered back into the reservoir beneath the surface of the liquid ink.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
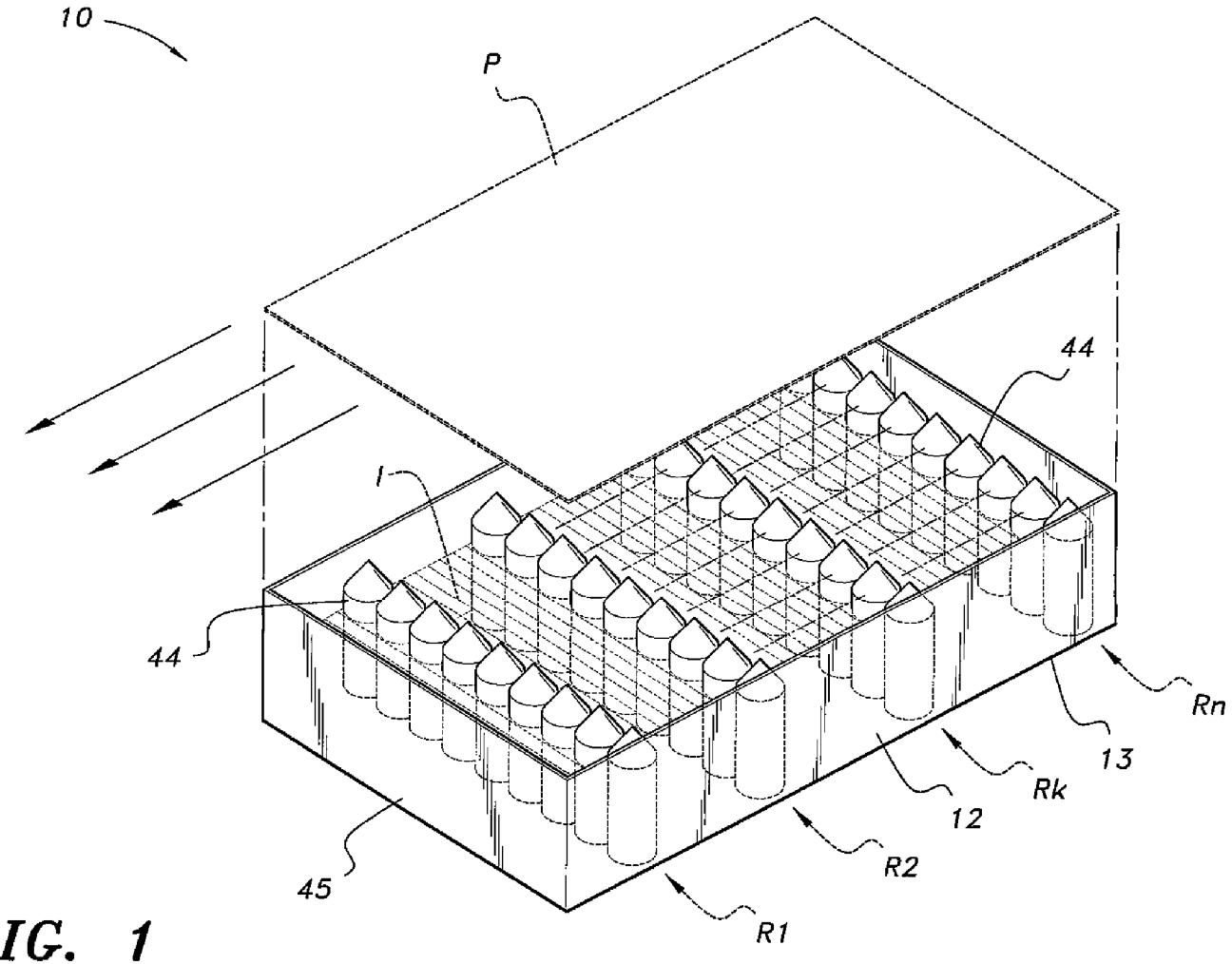
FIG. 1 is a perspective view of a printing system according to the present invention.
Figure 2A:
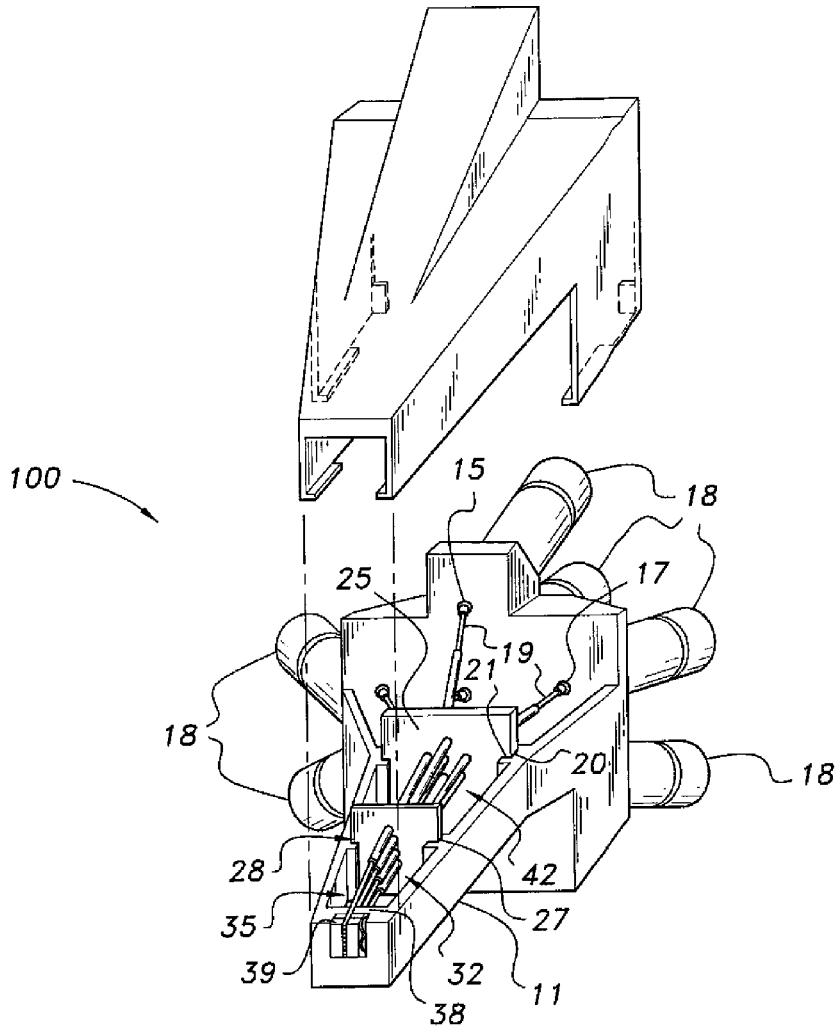
FIG. 2A PRIOR ART
FIG. 2A is a perspective view of a prior art dot matrix printer head.
Figure 2B:
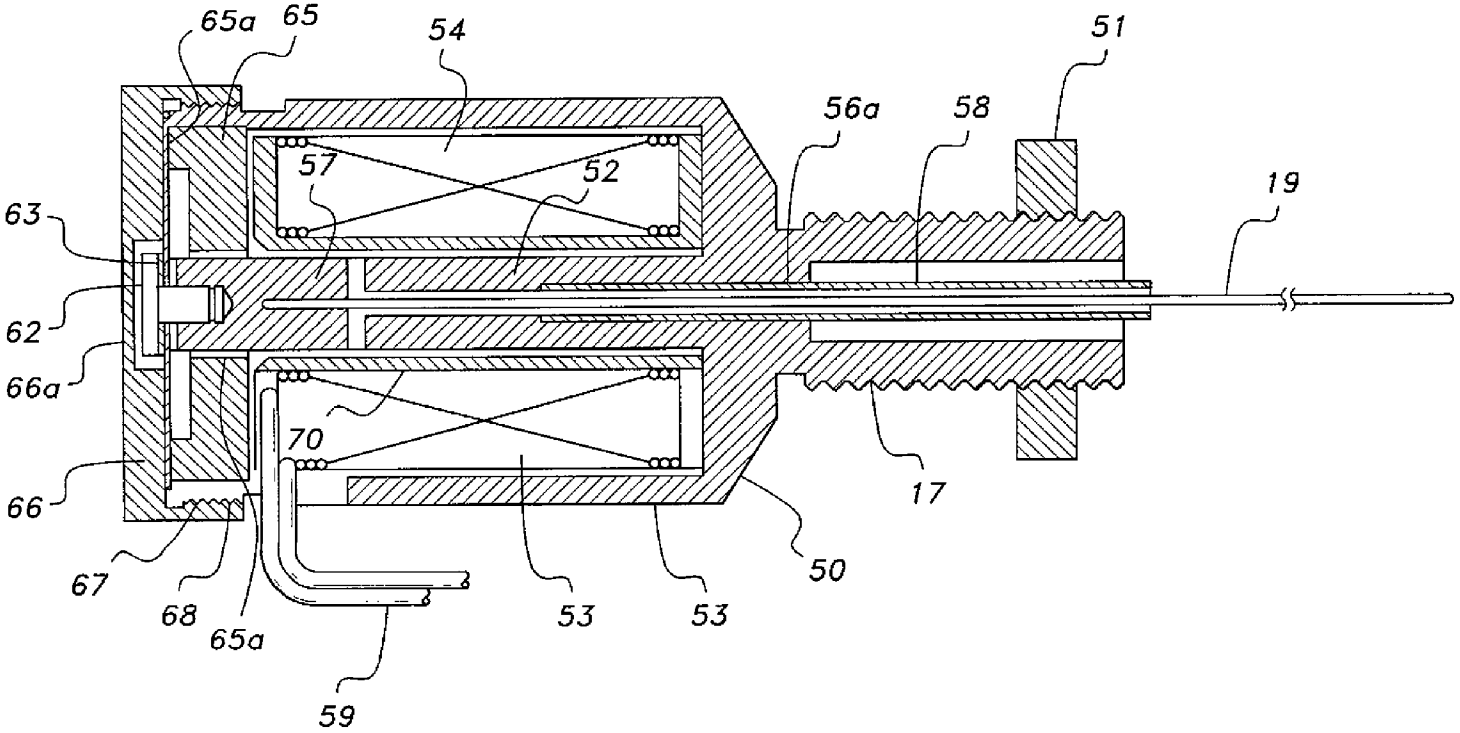
FIG. 2B PRIOR ART
FIG. 2B is a section view of a solenoid driver of the prior art dot matrix printer head of FIG. 2A.
Figure 2C:
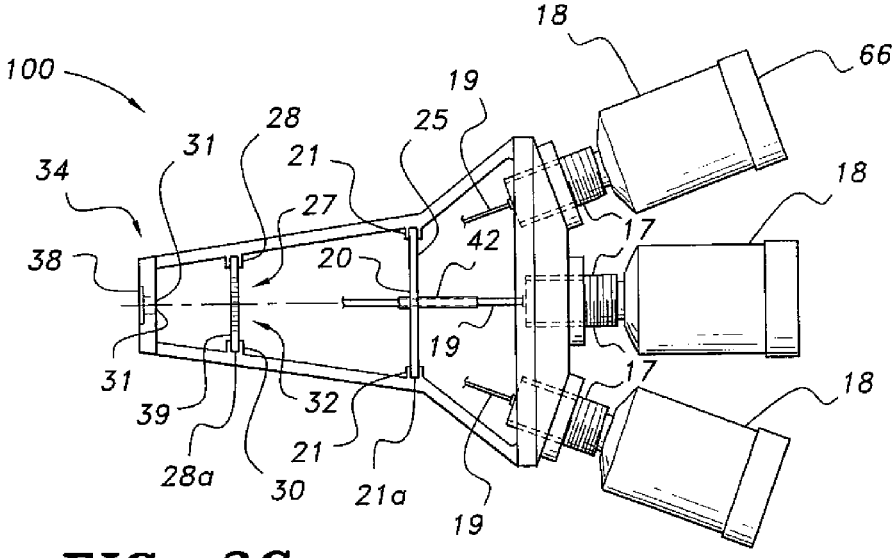
FIG. 2C PRIOR ART
FIG. 2C is a top view of the prior art dot matrix printer head of FIG. 2A.
Figure 2D:
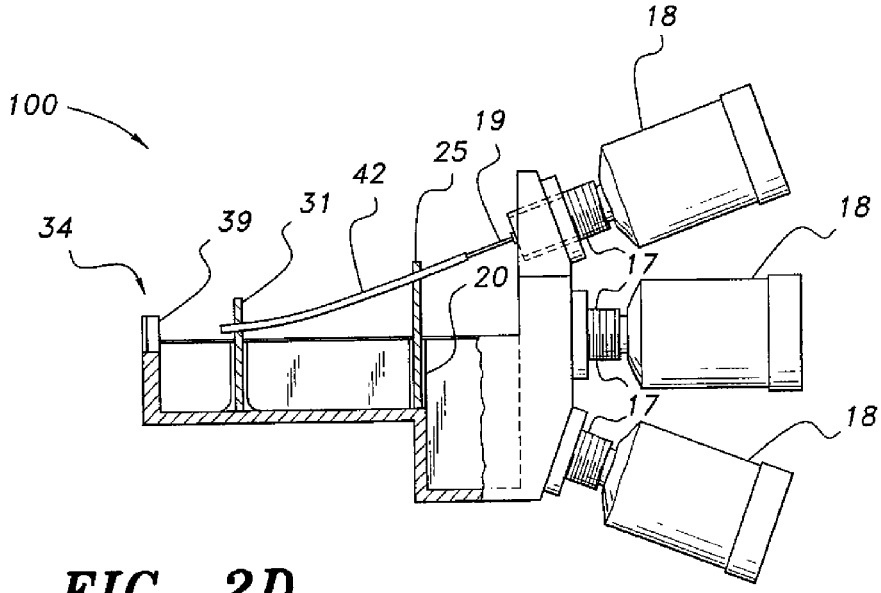
FIG. 2D PRIOR ART
FIG. 2D is a side elevational view of the prior art dot matrix printer head of FIG. 2A.

The printing system 10, as shown in FIG. 1, is a dot matrix-type printer utilizing a liquid ink reservoir 12. The reservoir 12 includes a lower wall 13, at least one sidewall 45 and an open upper end. Although the reservoir 12 is shown as being substantially rectangular in FIGS. 1 and 3, it should be understood that reservoir 12 may have any suitable shape or relative dimensions. The reservoir 12 is adapted for receiving a volume of liquid ink I, which may be any desired type of liquid ink.

Figure 3:
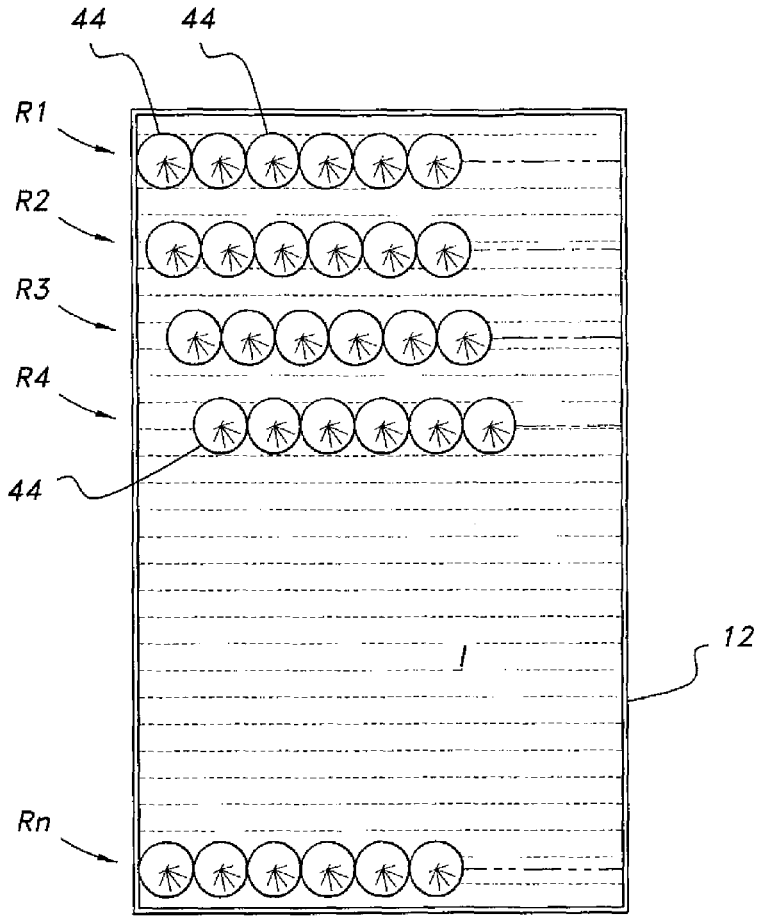
FIG. 3 is a top view of the printing system of FIG. 1.

A plurality of pins 44 are disposed within the reservoir 12, each pin 44 having a main body 16, which may be cylindrical, as shown, or may have any other suitable type of configuration, the main body 16 having a lower end and a tapered upper end terminating in a printing tip 48. As shown in FIGS. 1 and 3, the plurality of pins 44 are preferably arrayed in parallel rows within the reservoir 12, each pin 44 extending vertically with respect to the reservoir 12. In FIG. 1, only rows $R_1$, $R_2$, a central row $R_k$, and a final row $R_n$ are shown (and in FIG. 3, only the first four rows $R_1$, $R_2$, $R_3$, $R_4$ and the final row $R_n$ are shown), but it should be understood that rows $R_1$ through $R_n$ are formed as continuous, contiguous parallel rows of pins 44. Any suitable number of pins may be used in any single row, and any desired number of rows may be mounted within the reservoir 12.

In use, the reservoir 12 is held stationary, the liquid ink I being contained therein by gravity alone. A printing substrate, such as a piece of paper P, is drawn over the open upper end of the reservoir 12 by conventional means, such as rollers or the like. It should be understood that any suitable mechanism for drawing the paper P across the open upper end of reservoir 12 may be utilized. Such paper transfer mechanisms are well known in the field of copy machines, and such a copy machine roller system may be utilized to transfer the paper P across the upper end of the reservoir 12. One such system is shown in U.S. Pat. No. 4,009,957, which is hereby incorporated by reference in its entirety. As opposed to a conventional dot matrix printer, where a printer head moves relative to a stationary piece of paper, the paper P of the present system moves relative to the stationary reservoir 12.

Figure 5:
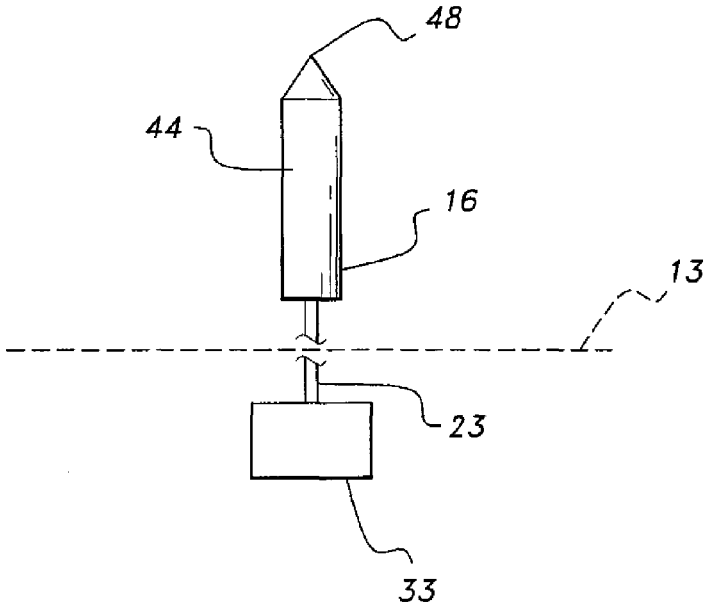
FIG. 5 is a diagrammatic view of a single pin of the printing system of FIG. 1, shown coupled with a driver.

As shown in FIG. 5, a driver 33 is provided for selectively translating each pin 44. The driver 33 may mechanically push the pin 44 via a support or mount 23, or may, for example, apply electromagnetic force to selectively translate the pin 44. It should be understood that any suitable driver for selectively translating each individual pin 44 may be used. For example, solenoid systems for selectively actuating pins in conventional dot matrix printers are well known in the art, and may be applied to the system 10. Such a system is shown in U.S. Pat. No. 3,833,105, which is hereby incorporated by reference in its entirety.

Figure 4B:
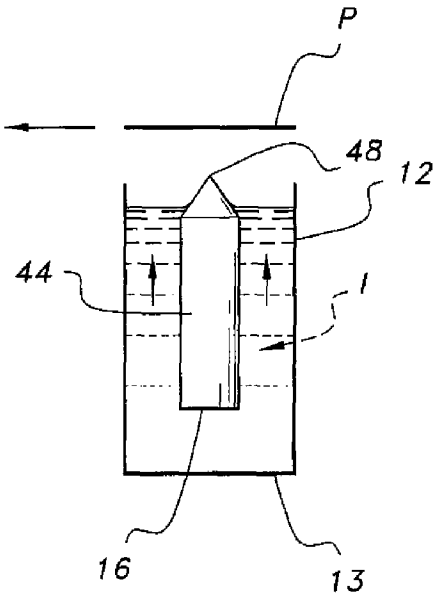
FIGS. 4A, 4B, 4C and 4D sequentially illustrate the printing of an ink dot on a piece of paper using a single pin of the printing system of FIG. 1.
Figure 4A:
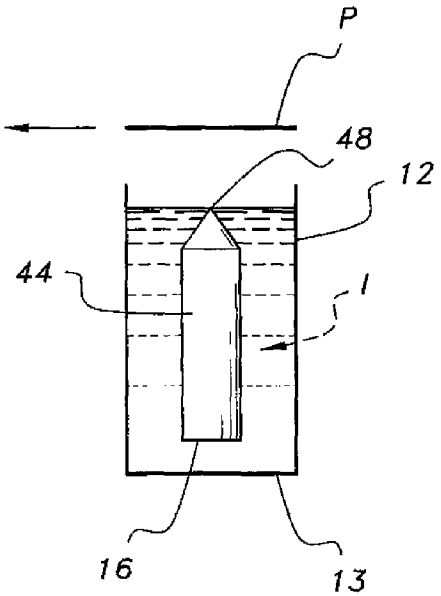
Figure 4D:
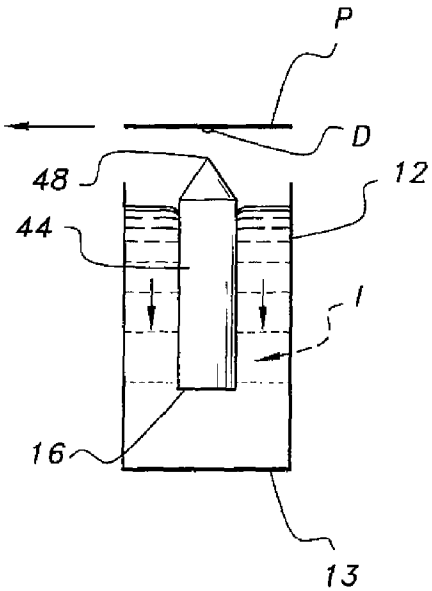
Figure 4C:
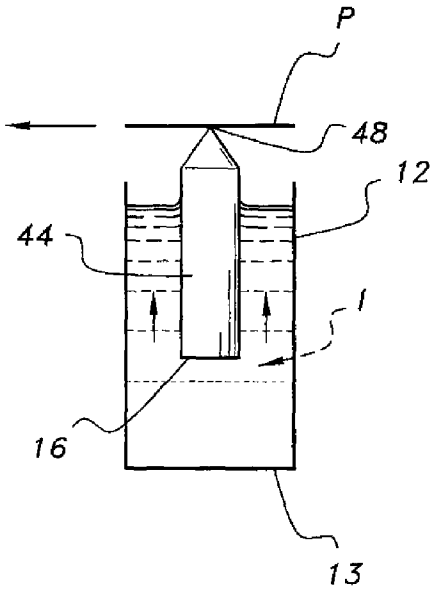

The driver 33 selectively vertically translates the plurality of pins 44, each individual pin 44 being selectively driven separate of the other pins 44. As shown in FIG. 4A, in a non-printing state, each pin 44 is positioned so that the lower end of main body 16 is located adjacent the lower wall 13 of the reservoir 12, and the printing tip 48 is positioned beneath a surface of the volume of ink I received within the reservoir 12. Paper P is passed across the open upper end of reservoir 12, and, as shown in FIG. 4B, the driver 33 selectively vertically translates at least one of the pins 44, urging the pin or pins 44 upward toward the underside of the paper P. As shown in FIG. 4C, the selected pin or pins 44 are translated upwardly so that the printing tip or tips 48 contact the printing substrate P to form a dot D thereon, the ink being carried on the surface of the printing tips 48 of the pins 44 by friction. As shown in FIG. 4D, the pin or pins 44 are then selectively lowered back into the reservoir 12 beneath the surface of the liquid ink I.

As best shown in FIG. 3, each row of pins 44 is preferably slightly shifted with respect to the adjacent rows (i.e., in the orientation of FIG. 3, the pins of row $R_2$ are slightly shifted to the right of the corresponding pins of row $R_1$, and the pins of row $R_3$ are slightly shifted to the right of the corresponding pins of row $R_2$, etc.) This provides for the production of a high-resolution image. As an example, we consider actuation of pins 44 such that each full row of pins is selectively actuated. If the pins of each row were aligned, without shifting, then sequential actuation of row $R_1$, row $R_2$, row $R_3$, etc. would generate closely spaced parallel lines on paper P, spaced apart by the distance between adjacent printing tips 48. However, because of the shifting of the pins 44 of each row in system 10, such sequential actuation of each full row would create a completely ink-covered plane, rather than a sequence of parallel lines. Thus, the resolution of printing is greatly increased by such a sequentially shifted orientation of the pins of each row.

It is to be understood that the present invention is not limited to the embodiments described above, but encompasses any and all embodiments within the scope of the following claims.

I claim:

1. A printing system, comprising:

a reservoir having a lower wall, at least one side wall and an open upper end, the reservoir being adapted for receiving a volume of liquid ink;

a plurality of pins disposed within the reservoir, each of the pins having a lower end and a tapered upper end terminating in a printing tip, the plurality of pins being arrayed in a plurality of parallel rows within the reservoir, each of the pins extending vertically with respect to the reservoir;

means for selectively passing a printing substrate over the open upper end of the reservoir; and means for selectively vertically translating the plurality of pins, such that, in a non-printing state, each of the pins is positioned with the lower end located adjacent the lower wall of the reservoir and the printing tip positioned beneath a surface of the volume of ink within the reservoir, and such that, upon selective vertical translation of one of the pins, the selected pin is translated upwardly, the printing tip carrying ink thereon and contacting the printing substrate to form a dot thereon.

2. The printing system as recited in claim 1, wherein each said pin has a substantially cylindrical main body.

3. The printing system as recited in claim 2, wherein the tapered upper end of each said pin is substantially conical.

4. The printing system as recited in claim 1, wherein the at least one side wall and said plurality of pins each extend vertically and the lower wall extends horizontally so that the volume of ink is held within said reservoir by gravity alone.

5. The printing system as recited in claim 4, wherein each said parallel row of pins extends along a lateral direction with respect to said reservoir.

6. The printing system as recited in claim 5, wherein each said parallel row of pins is longitudinally spaced apart from adjacent ones of said plurality of parallel rows of pins.

7. The printing system as recited in claim 6, wherein longitudinally adjacent individual pins of adjacent ones of said plurality of parallel rows of pins are offset along the lateral direction.

8. A printing system, comprising:

a reservoir having a lower wall, at least one side wall and an open upper end, the reservoir being adapted for receiving a volume of liquid ink, the at least one side wall extending vertically and the lower wall extending horizontally so that the volume of ink is held within said reservoir by gravity alone;

a plurality of pins disposed within the reservoir, each of the pins having a lower end and a tapered upper end terminating in a printing tip, the plurality of pins being arrayed in a plurality of parallel rows within the reservoir, each of the pins extending vertically with respect to the reservoir;

means for selectively passing a printing substrate over the open upper end of the reservoir; and means for selectively vertically translating the plurality of pins, such that, in a non-printing state, each of the pins is positioned with the lower end thereof located adjacent the lower wall of the reservoir and the printing tip thereof positioned beneath a surface of the volume of ink within the reservoir, and such that, upon selective vertical translation of one of the pins, the selected pin is translated upwardly, the printing tip carrying ink thereon and contacting the printing substrate to form a dot thereon.

9. The printing system as recited in claim 8, wherein each said pin has a substantially cylindrical main body.

10. The printing system as recited in claim 9, wherein the tapered upper end of each said pin is substantially conical.

11. The printing system as recited in claim 10, wherein each said parallel row of pins extends along a lateral direction with respect to said reservoir.

12. The printing system as recited in claim 10, wherein each said parallel row of pins is longitudinally spaced apart from adjacent ones of said plurality of parallel rows of pins.

13. The printing system as recited in claim 12, wherein longitudinally adjacent individual pins of adjacent ones of said plurality of parallel rows of pins are offset along the lateral direction.

* * * * *